United States Patent [19]

Stein

[11] 3,930,578

[45] Jan. 6, 1976

[54] CONTAINER PACKAGE

[76] Inventor: Richard J. Stein, 147 Brite Ave., Scarsdale, N.Y. 10583

[22] Filed: Apr. 22, 1974

[21] Appl. No.: 462,921

[52] U.S. Cl. ..... 206/150; 206/428; 224/45 AA; 294/87.2; 206/805; 206/497; 229/DIG. 12

[51] Int. Cl.[2] ..... B65D 85/62; B65D 75/56; B65D 71/02

[58] Field of Search ..... 206/150, 145, 163, 431, 206/428, 427, 497; 224/45 AA, 45 AB, 45 C, 45 P; 294/87.2, 87.28; 220/23.4; 229/DIG. 12

[56] References Cited

UNITED STATES PATENTS

| | | | |
|---|---|---|---|
| 2,680,039 | 1/1954 | Burge | 206/150 |
| 2,853,186 | 9/1958 | Holmberg | 206/145 |
| 2,891,664 | 6/1959 | Goyert | 206/145 |
| 2,931,491 | 4/1960 | Taylor | 206/431 |
| 3,097,740 | 7/1963 | Powpitch | 206/150 |
| 3,232,422 | 2/1966 | Whyte | 206/428 |
| 3,307,321 | 3/1967 | Beart | 206/150 |
| 3,822,012 | 7/1974 | Weaver | 206/151 |

*Primary Examiner*—William T. Dixson, Jr.
*Attorney, Agent, or Firm*—Eyre, Mann & Lucas

[57] ABSTRACT

Packaging in the form of a carrier for holding and carrying a plurality of containers such as cans, bottles, jars and the like is disclosed. The carrier comprises at least one packaging band which completely encloses a plurality of containers arranged in at least one row while incompletely enclosing the periphery of any individual container. At least one carrying band is associated with the at least one packaging band to provide means for grasping and lifting the container package. Several combinations of enclosed rows, each containing a plurality of containers, are disclosed along with appropriate carrying bands.

22 Claims, 15 Drawing Figures

CONTAINER PACKAGE

BACKGROUND OF THE INVENTION

1. Field of the Invention

This invention relates to packaging for a plurality of containers such as cans, bottles, jars and the like. More particularly, this invention relates to carriers more commonly known as multipacks.

2. Description of the Prior Art

A package for holding and carrying a plurality of containers is commonly referred to as a multipack, or, when used for holding and carrying six containers, a six-pack. Many known carriers or multipacks so enclose the individual containers that they are either fully or partially obscured, thereby reducing whatever consumer eye appeal the containers themselves presented. Also, known carriers require considerable material and labor to manufacture and to insert the containers. In many known carrier packages, especially in those where the carrier material completely encircles or encloses the periphery of each individual container, considerable material is required; and where the complete encirclement or enclosure of each individual container periphery is accomplished by stamping holes in a sheet of carrier material, considerable material is wasted.

In known carrier packages, the arrangement for grasping and carrying the package usually comprises a plurality of holes in the top of the carrier package into which one's fingers are inserted. In each case of a basket type carrier, finger grips or holes in the rigid center board are required. All of these aforementioned carrying arrangements are awkward and uncomfortable and usually prevent carrying of more than one package in a hand at one time.

The present invention eliminates all of the aforesaid drawbacks and disadvantages; the unit cost and quantity of material required are minimized as well as the labor required to fabricate the carrier and container package. The minimum amount of material used permits maximum exposure of the individual containers to the consumer to thereby provide eye appeal required in selling.

SUMMARY OF THE INVENTION

The present invention is embodied in and carried out by a carrier comprising holding or packaging band means that encloses a plurality of containers arranged in at least one row, the holding means incompletely enclosing the periphery of any individual container in any given plane through the container, and carrying means associated with the holding means to permit lifting of the enclosed plurality of containers as a package. Preferably, the carrying means is so associated with the holding means that at least two of the individual containers are drawn together when the package is lifted and carried by the carrying means. In this way, the relative forces involved when a package is lifted and being carried cooperate to advantageously assist in holding the carrier package together. It is not necessary that the individual containers in the package have the same size or shape or be made of the same material. In a preferred embodiment a packaging or holding band is drawn taut around the containers and if desired the packaging band may be attached to individual containers or adjacent packaging bands may be attached to each other.

BRIEF DESCRIPTION OF THE DRAWING

Further details of the invention may be readily understood by reference to the drawing which illustrates the preferred embodiments and in which.

DESCRIPTION OF SOME PREFERRED EMBODIMENTS

Figure 1:
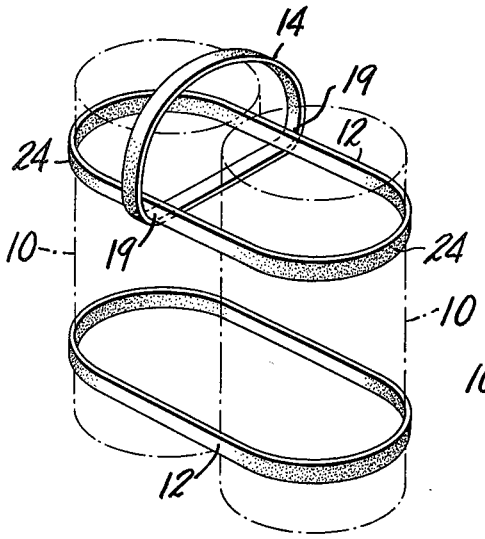
FIG. 1 is a perspective view of two containers packaged according to the invention.
Figure 2A:
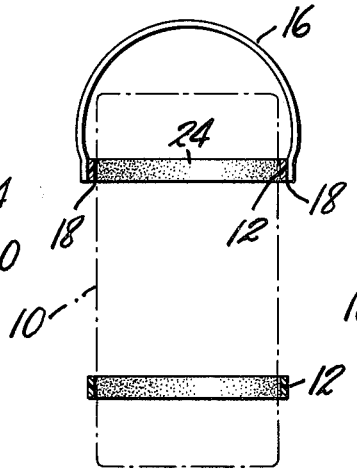
FIGS. 2*a* and 2*b* are sectional views of the two container package shown in FIG. 1 also showing alternate embodiments of carrying means.
Figure 2B:
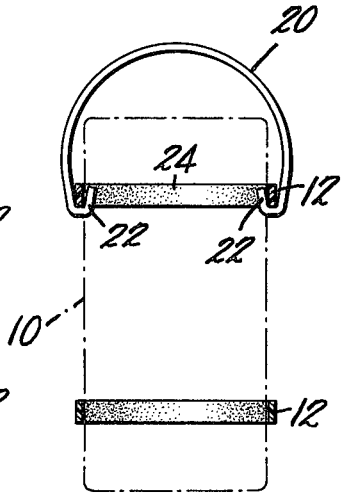

Referring to FIGS. 1 and 2, two containers 10 are shown arranged upright in a row and held together by one or more packaging bands or films or straps or the like 12 which tightly enclose the containers 10 as a group along a direction generally perpendicular to the upright direction while only partially enclosing the periphery of any individual container. Although two bands 12 are shown, one is sufficient to hold the containers 10 together. One or more carrier bands 14 or films or strips or handles or the like is associated with one of the packaging bands 12, preferably the upper one. The carrier band may be an integral loop as shown at 14 in FIG. 1 which loosely encircles opposite portions of band 12 between the containers 10 or it may be in the form of an open ended loop 16 attached as by welding at opposite ends 18 to opposite portions of band 12 between containers 10, as shown in FIG. 2*a*. Alternatively, the open ended carrier band 20 may be provided with rigid attachment clips 22 at opposite ends thereof which hook under opposite portions of band 12 between the containers 10, as shown in FIG. 2b. If desired, the integral loop 14 may be attached to band 12 and the attachment clips 22 may be crimped or otherwise attached to band 12. The open ended loop may additionally have the opposite ends thereof attached to one of the containers 10 at opposite sides thereof (not shown) to form an operative association with the packaging band for lifting the packaged containers although this arrangement is not preferred in most applications. Where the containers are arranged in more than one row, the open ended loop 16 may have the opposite ends thereof attached to the outermost surfaces of the two outermost containers to form the said operative association with the packaging band. Hereinafter the exact manner of connection of the carrier bands will not be described in detail since it will be in one of the aforementioned manners or equivalents thereof. When so associated, the carrier band 14, when urged upwards, as, for example, when lifting the package, tends to urge band portions 19 upwardly thereby camming band portions 24 inwardly. Thus, when the package is lifted, the containers are drawn together to enhance and reinforce the holding effect of band 12.

Figure 3:
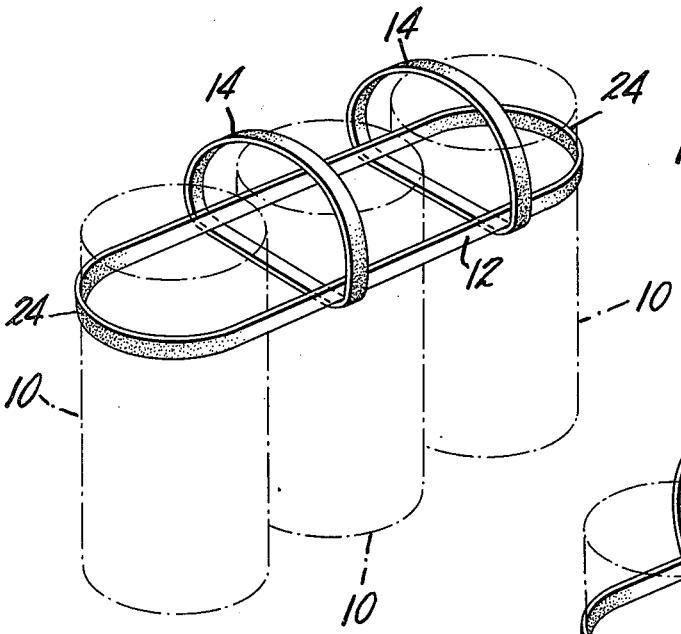
FIG. 3 is a perspective view of a row of three containers showing holding and carrying means according to the invention.

Referring now to FIG. 3, where three containers 10 are shown, it may be desirable to use a plurality of carrying bands 14 so that the packaged containers remain level when lifted by the bands 14. Thus, a number of carrier bands 14 positioned at different locations may be desired depending on the package content and arrangement.

Figure 4:
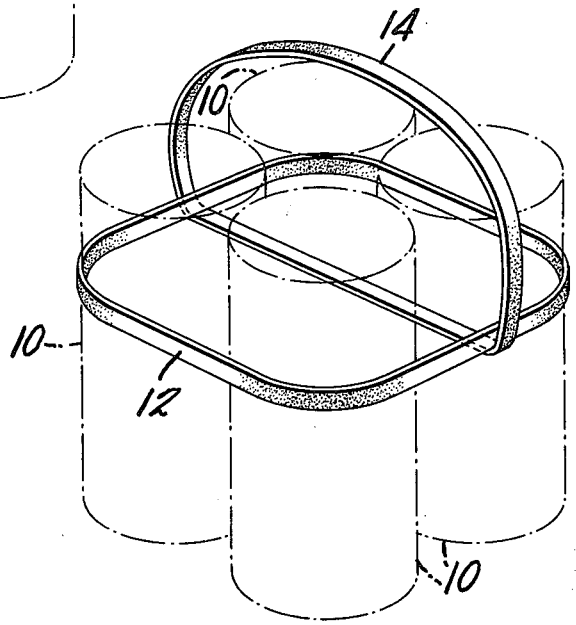
FIGS. 4 and 6 are perspective views of pluralities of rows of containers showing holding and carrying means according to the invention.
Figure 5:
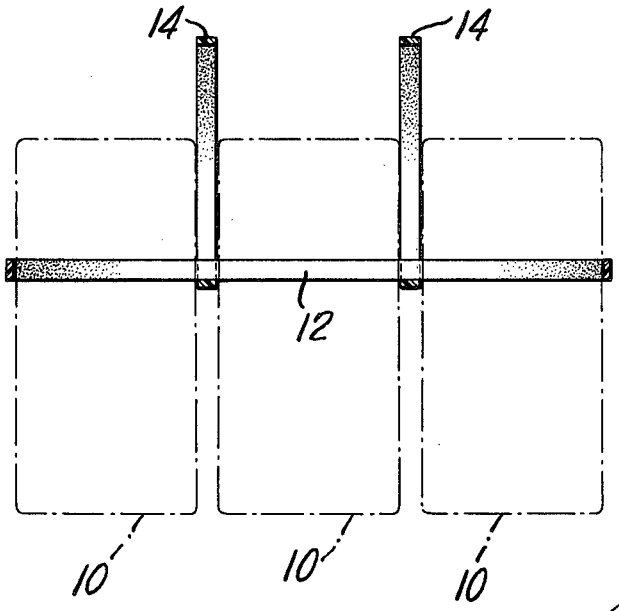
FIGS. 5 and 7 are sectional views of pluralities of rows of containers showing holding and carrying means according to the invention.

Referring to FIGS. 4–5 different package contents and arrangements of containers are shown. In each, the containers are enclosed by packaging bands and the carrying bands are arranged so that the containers are drawn together when the package is lifted by the carrying bands as described hereinabove.

In FIGS. 4 and 5 a plurality of rows each having a plurality of containers are shown enclosed by a single packaging band 12. For the four container package of FIG. 4, a single carrying band is loosely looped to surround the packaging band between the two rows similar to the carrying band shown in FIG. 1. In FIG. 5, two carrying bands 14 are arranged in a manner similar to that shown in FIG. 3, with each carrying band being loosely looped to surround the packaging band at opposite sides of the center row of containers.

Figure 6:
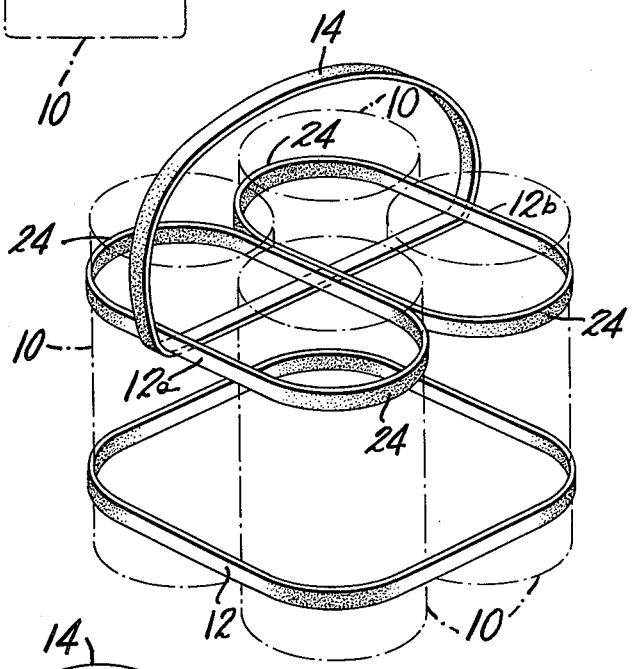
Figure 7:
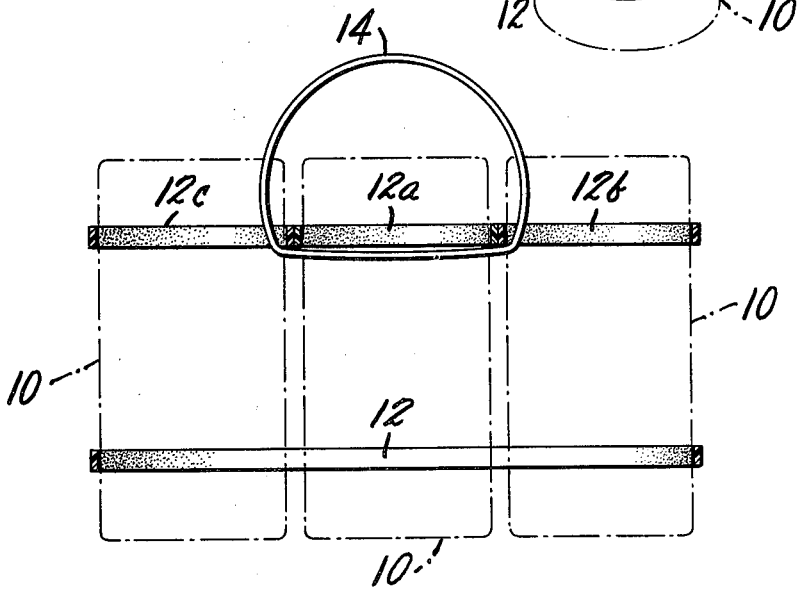

In FIGS. 6 and 7 a plurality of containers are arranged in a plurality of rows and each individual row is enclosed by an individual packaging band. The bands are preferably run around the individual rows in the direction of the shortest package dimension. The individual rows are then arranged in juxtaposition and a carrying band 14 is looped around or is otherwise affixed as described hereinabove to at least one side of each individual packaging band. In the four container package shown in FIG. 6, the carrier band 14 is looped around opposite portions of each packaging band 12a, 12b running between the containers. Additionally, another holding band 12 may enclose the exterior of the entire package. Alternatively, a single continuous packaging band may be employed to enclose the individual rows of containers in place of the individual packaging bands for individual rows. In the six-pack of FIG. 7, the carrier band 14 is shown looped around opposite portions of the packaging band **12*a* enclosing the innermost row and looped around only the inner portions of the packaging bands 12*b* and 12*c*** enclosing the two outermost rows.

Figure 8:
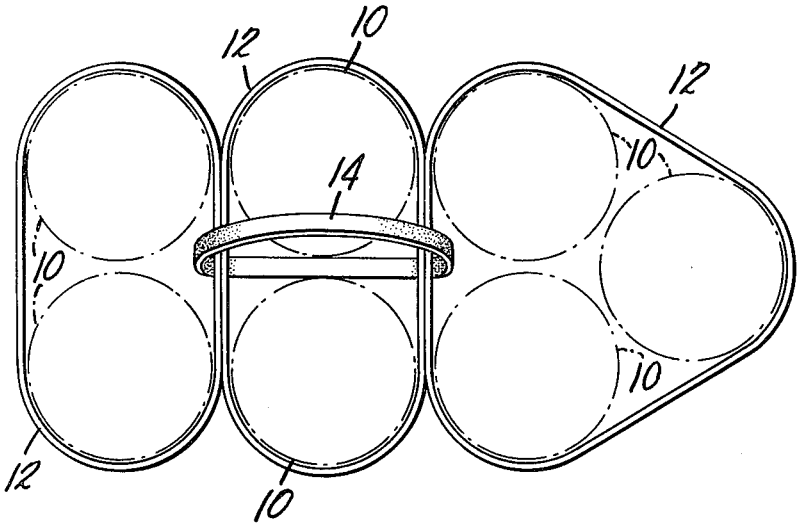
FIGS. 8–13 are plan views of different arrangements and configurations of containers and carrying and holding means according to the invention.

FIG. 8 is a plan view of the package of FIG. 7 except also showing that one of the rows, preferably an outermost row, may contain more containers than other rows. Thus, an odd number of containers, for example 7, may be provided in a single package. The carrying band 14 may be looped to surround opposite portions of all of the packaging bands for all of the individual rows having an even number of containers as shown in FIG. 6 or extended to surround only the inner portion of the packaging bands enclosing the outermost rows as shown in FIGS. 7 and 8.

Figure 9:
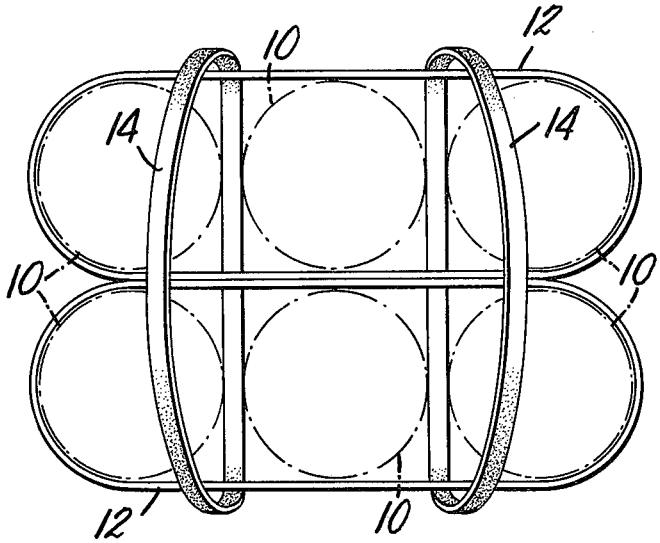

In FIG. 9 the plurality of containers which are arranged in individual rows are enclosed by bands 12 running along the longest dimension of the package. Two carrier bands 14 are shown loosely surrounding opposite portions of the upper packaging bands 12. However, as shown in FIGS. 7 and 8, the carrier bands may surround only the inner portion of the packaging bands.

Figure 10:
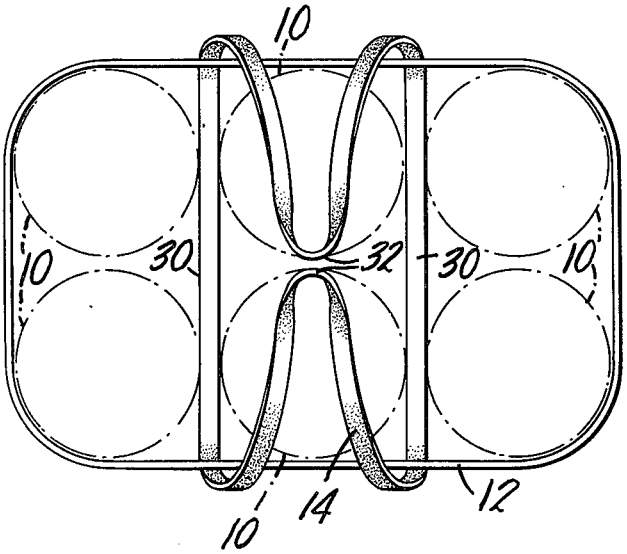

In FIG. 10 the containers are enclosed as shown in FIG. 5. Carrying band 14 is a closed loop with its sides 30 running beneath packaging band 12 on opposite sides of the innermost pair of containers with the ends of the loop 32 extending upward to form a pair of handles. The loop ends 32 are preferably joined.

Figure 11:
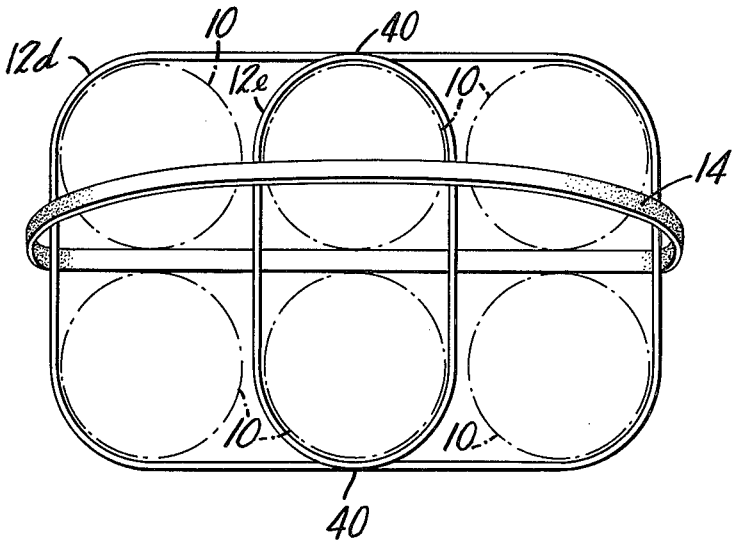

In FIG. 11 the package is shown with a packaging band **12*d* that surrounds the exterior of the stack of containers and a second separate or integral packaging band 12*e* that encloses an individual row of containers, preferably the innermost pair. The band 12*d* and the band 12*e* may be affixed together at points 40 and may be a single continuous band. Carrying band 14 is loosely looped to surround opposite portions of all the packaging bands or alternatively the carrying band as shown in FIG. 10** may advantageously be used.

Figure 12:
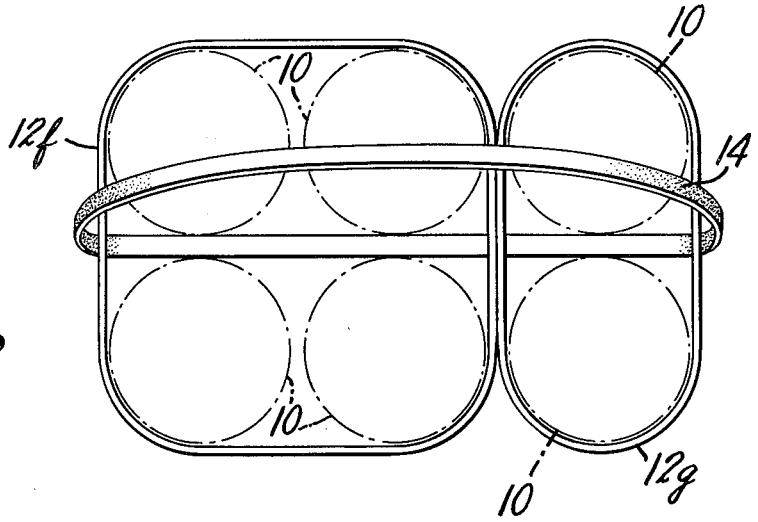

In FIG. 12, a package is shown with packaging bands **12*f* and 12*g*** enclosing four and two containers respectively. Thus, all enclosed groups of containers need not contain the same number of containers.

Figure 13:
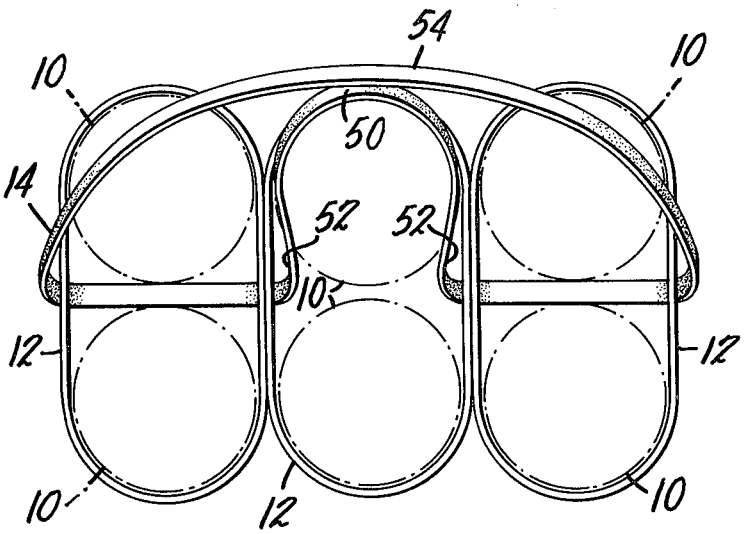

FIG. 13 shows rows of containers individually joined similar to those in FIGS. 6 and 7. Carrying band 14 forms a handle at 50 with both handle ends 52 running downwards between the containers of the innermost row and continuing under at least one of each of the sides of the packaging bands 12 for each of the individual rows and back over on top of the same bands and joined at 54 to form a second handle. Preferably, the two handles are joined.

Figure 14:
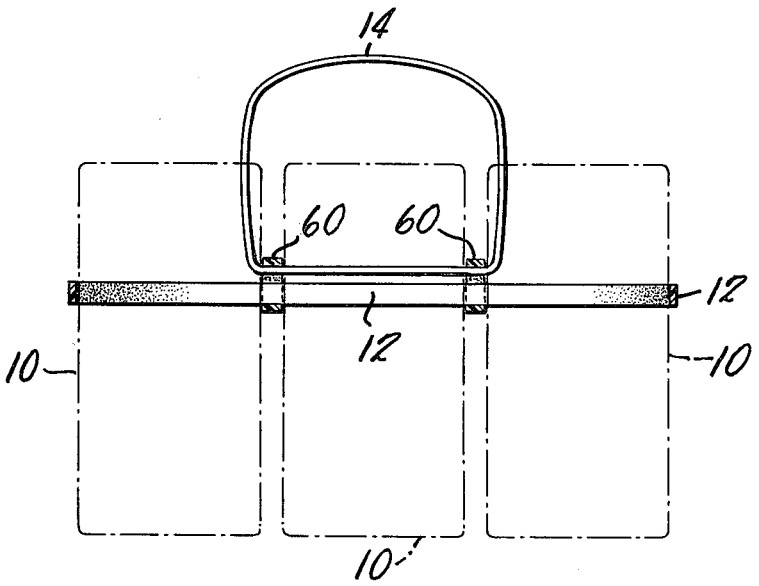
FIGS. 14–15 are sectional views of still other arrangements of pluralities of containers showing carrying and holding means according to the invention.

FIG. 14 shows a package similar to the one shown in FIG. 5 except that bands 60 are tightly fastened so that there is no excess to form a handle. An additional band 14 is then run under the bands 60 to form the handle loop.

Figure 15:
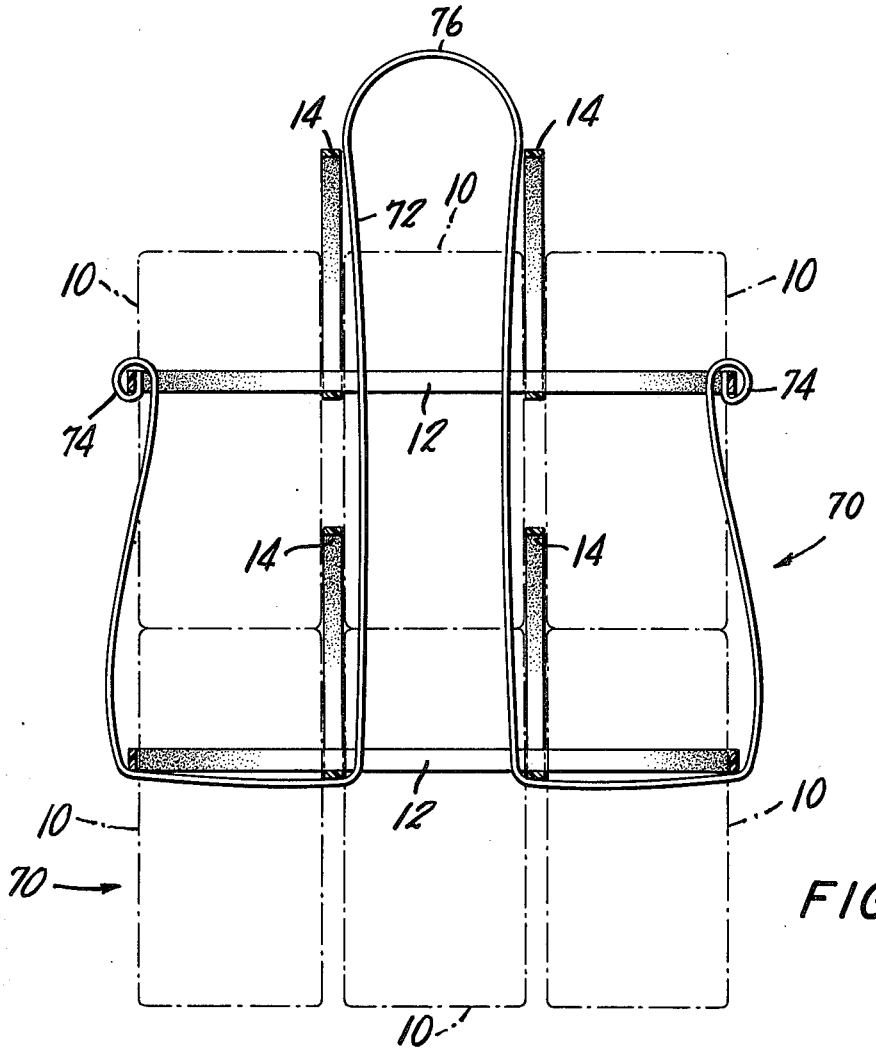

Referring to FIG. 15, a package is shown in which a plurality of rows 70 of containers 10 are stacked in vertical direction on top of each other. Each of the rows may consist of separate packages held together as described hereinabove or the several levels and rows may be held together by a single carrying band 72. Each of the levels may be provided with a carrying band 14 if desired in addition to carrying band 72 for the entire package. Alternatively, only a single carrying band 72 for the entire package could be provided. Where it is desired that the individual levels be capable of separation from the package for individual carrying, carrying bands 14 are provided for each level and carrying band 72 is detachable. The ends of carrying band 72 may be connected to the upper band 12 at 74 and then looped down around the exterior of lower band 12 and brought up through the spaces between the innermost containers 10 forming a carrying loop 76. When lifting the entire package by loop 76, both the upper and lower bands 12 will be drawn inwardly to force the outermost containers 10 inwardly to aid in holding the package together.

Different materials may be used for the holding means and carrying means. The materials will vary according to the size, shape, weight, contents and handling of the individual containers and the environment to which the package will be exposed. The carrying means or band or handle or strap may be made of a rather rigid material such as corrugated board, paper board, wood or rigid plastic, or preferably, a flexible material such as paper, rubber or textile may be used and for best results a plastic film is used. The selected material may be used alone or combined with one or more other materials. The plastic film or other selected material may be adhesively or cohesively sealed, or heat-sealed, or stapled, or stitched to form the packaging loop that encloses the containers. By tightly enclosing the containers thereby, the package requires nothing further insofar as holding the individual containers together in a package is concerned. For increased performance, the film may be adhesively or cohesively affixed to the individual containers or adjacent packaging bands may be attached to each other. It is not necessary that there be adhesive contact between the film and an individual container, although such an arrangement is preferred in some applications. Heat shrinking the plastic film to tightly enclose the plurality of containers is also preferred. An adhesive arrangement may be desired to maintain remaining containers in a package after one or more have been removed.

In the preferred embodiments illustrated in the drawings, the packaging band is a flat planar strip of material which for best results is not more in width than about half the height of the container and in general will be about 2 or less in width. The planar face of the packaging band is in physical contact with the wall of the container and friction between the two contacting surfaces is great enough to lift and maintain the containers in the package as formed by the packaging band.

The advantages of the present invention, as well as certain changes and modifications of the disclosed embodiments thereof, will be readily apparent to those skilled in the art.

For example, different materials may be used for the holding means and carrying means without departing from the spirit and scope of this invention. Similarly, the holding bands may be joined and drawn taut by other ways then those specifically disclosed. In like manner, the carrying band may be affixed to the holding means or positioned with respect to the holding means in configurations other than those specifically disclosed. For example, where the carrying bands run generally transverse to the longer dimension of the carrier package, it would be acceptable to run the carrying bands parallel to the said longer dimension. In similar fashion, where two distinct bands are disclosed, they may be replaced by a single continuous band. The exact location of the packaging band with respect to the height of the containers will depend upon container shape. However, in the preferred structure for cans, the carrying band is arranged transversely to the packaging band and for best results the packaging band is located at or near the center of the vertical height of the cans in the package; and in the preferred structure for bottles having necks, the packaging band is located at or below the center of the vertical height of the bottles in the package. Where a container has a waist portion, of course, the preferred location for the packaging band may be at the container waist.

The combination and arrangement of containers, and the running of the respective bands as disclosed herein are intended to be illustrative and not exhaustive. Other configurations and arrangements of the containers and the bands will readily be apparent to those skilled in the art.

For example, the packaging band may be affixed at one end to a first container in the package and looped around the exterior of the containers and affixed at the second end to the said first container in order to enclose the packaged containers. Additional bands or strips may be added running parallel to those disclosed or running in a different plane to those disclosed.

Additionally, in order to increase the strength of the package or to better protect the containers, for stacking purposes a cover and/or base may be added. A cover may also be desirable for dust protection.

An adhesive or cohesive material may be attached to adjacent containers so that the containers are adhesively joined in addition to being joined by the packaging band.

The carrying bands may be made in the form of separators to separate individual containers for additional container protection and stability.

It is the Applicant's intention to cover all those changes and modifications which could be made to the embodiments of the invention herein chosen for the purposes of the disclosure without departing from the spirit and scope of the invention.

What is claimed is:

1. A container package comprising at least one packaging band that encloses a plurality of containers arranged in at least one row, said packaging band incompletely enclosing the periphery of each individual container while completely enclosing the said at least one row of containers, said packaging band having portions at opposite sides thereof which are not in physical contact with said containers, and at least one carrying band of flexible materials operatively associated with said at least one packaging band at the said opposite portions thereof to lift and draw said opposite portions of the packaging band inwardly and to draw the containers together when said at least one carrying band is lifted to lift the enclosed plurality of containers as a package.

2. The container carrier according to claim 1 wherein the packaging band is in position spaced downwardly away from the periphery of the top of the container.

3. The container carrier according to claim 1 wherein said at least one packaging band encloses said containers in a direction substantially perpendicular to the upright direction of the containers

4. The container carrier according to claim 3 wherein said at least one flexible carrying band is an integral loop positioned to loosely enclose the said opposite portions of said at least one packaging band.

5. The container carrier according to claim 3 wherein said at least one flexible carrying band is an open-ended loop connected at opposite ends thereof to said at least one packaging band at said opposite portions thereof.

6. The container carrier according to claim 5 wherein said at least one flexible carrier band has rigid hooked end portions operative to engage said packaging band at said opposite portions thereof.

7. The container carrier according to claim 1 wherein:

a. said plurality of containers number at least four arranged in at least two rows of at least two; and b. said at least one packaging band is positioned to enclose said at least two rows running in a direction substantially perpendicular to the upright direction of the containers.

8. The container carrier according to claim 7 wherein the number of rows is even and said at least one flexible carrying band comprises an integral loop positioned to loosely enclose said at least one packaging band between the two innermost rows of containers at said opposite portions thereto.

9. The container carrier according to claim 7 wherein the number of rows is odd and said at least one flexible carrying band comprises two integral loops positioned to loosely enclose said at least one packaging band between the innermost and one adjacent rows of containers and between the innermost and another adjacent rows of containers at said opposite portions thereof.

10. The container carrier according to claim 1 wherein:

a. said plurality of containers number at least four arranged in at least two rows of at least two;

b. said at least one packaging band is positioned to enclose each of the container rows individually, running in a direction substantially perpendicular to the upright direction of the containers; and c. said at least one flexible carrying band comprises at least one integral loop positioned to loosely enclose at least a portion of said at least one packaging band at at least one location for each of said rows at the said opposite portions thereof.

11. The container carrier according to claim 10 further comprising a second packaging band tightly enclosing said at least two rows in a direction substantially perpendicular to the upright direction of the containers.

12. The container carrier according to claim 1 wherein:

a. said plurality of containers number at least six arranged in at least three rows of at least two;

b. said packaging band is positioned to enclose said at least three rows running in a direction substantially perpendicular to the upright direction of the containers; and c. said at least one flexible carrying band comprises an integral loop having side portions running between the innermost and one adjacent rows and between said innermost another adjacent rows beneath said at least one packaging band at the said opposite portions thereof and having end portions extending beyond opposite ends of the containers of the innermost row operative to be pulled upwards above the containers to form carrying handles.

13. A container carrier according to claim 7 further comprising an identical second level of containers stacked thereon and further comprising at least one flexible carrying band for the two levels of containers operative, when lifted, to lift the two levels as a package.

14. The container carrier according to claim 1 wherein:

a. said plurality of containers number at least six arranged in at least three rows of at least two;

b. said at least one packaging band is positioned to enclose said at least three rows running in a direction substantially perpendicular to the upright direction of the containers; and c. said at least one flexible carrying band comprises two integral loops tightly enclosing said packaging band at said opposite portions thereof between the innermost and one adjacent rows of containers and between the innermost and another adjacent row of containers and another integral loop loosely enclosing at least a portion of said two integral loops.

15. The container carrier according to claim 1 wherein:

a. said plurality of containers number at least six arranged in at least three rows of at least two; and b. said at least one packaging band comprises at least one first packaging band positioned to enclose said at least three rows running in a direction substantially perpendicular to the upright direction of the containers and an at least one second packaging band positioned to enclose another row.

16. The container carrier according to claim 15 wherein said at least one carrying band is an integral loop loosely enclosing at least a portion of said at least one first and second packaging bands at the said opposite portions thereof.

17. The container carrier according to claim 15 wherein said at least one carrying band comprises an integral loop having side portions running between the innermost and one adjacent rows and between said innermost another adjacent rows beneath said at least one first packaging band at the said opposite portions thereof, said flexible carrying band having end portions extending beyond opposite ends of the containers of the innermost row operative to be pulled upwards above the containers to form carrying handles.

18. The container carrier according to claim 17 wherein said carrying handles are joined.

19. The container carrier according to claim 15 wherein said at least one first and second packaging bands comprise a continuous band.

20. The container carrier according to claim 3 wherein said at least one packaging band is joined about said containers adhesively.

21. The container carrier according to claim 3 wherein said at least one packaging band is heat shrinkable and tightly drawn about said containers by the application of heat.

22. The container carrier according to claim 3 wherein said at least one packaging band is adhesively coated on a surface thereof, said surface contacting at least a portion of each outer container.

* * * * *